US010434798B2

(12) United States Patent
Nakata

(10) Patent No.: US 10,434,798 B2
(45) Date of Patent: Oct. 8, 2019

(54) PRINTING APPARATUS

(71) Applicant: SEIKO EPSON CORPORATION, Tokyo (JP)

(72) Inventor: Masanori Nakata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/867,460

(22) Filed: Jan. 10, 2018

(65) Prior Publication Data

US 2018/0215173 A1 Aug. 2, 2018

(30) Foreign Application Priority Data

Jan. 31, 2017 (JP) ..... 2017-015154

(51) Int. Cl.

| | |
|---|---|
| ***B41J 11/00*** | (2006.01) |
| ***B41J 2/01*** | (2006.01) |
| ***B65H 5/02*** | (2006.01) |
| *B41J 3/60* | (2006.01) |

(52) U.S. Cl.

CPC ..... *B41J 11/006* (2013.01); *B41J 2/01* (2013.01); *B41J 11/007* (2013.01); *B41J 11/0095* (2013.01); *B65H 5/021* (2013.01); *B41J 3/60* (2013.01); *B65H 2301/5133* (2013.01)

(58) Field of Classification Search

None

See application file for complete search history.

(56) References Cited

U.S. PATENT DOCUMENTS

| | | | | |
|---|---|---|---|---|
| 5,655,252 | A * | 8/1997 | Miyawaki | B08B 1/007 15/22.3 |
| 8,104,888 | B2 * | 1/2012 | Sugimoto | B41J 2/16585 347/101 |
| 2010/0073449 | A1 * | 3/2010 | Yamamoto | B41J 11/0085 347/104 |
| 2010/0128097 | A1 | 5/2010 | Sootome | |
| 2010/0225689 | A1 | 9/2010 | Kato et al. | |
| 2013/0027473 | A1 * | 1/2013 | Branham | B41J 2/14 347/50 |

FOREIGN PATENT DOCUMENTS

| | | | |
|---|---|---|---|
| JP | 2002-046310 | A | 2/2002 |
| JP | 2010-120334 | A | 6/2010 |
| JP | 2010-208721 | A | 9/2010 |
| JP | 2017-109811 | A | 6/2017 |
| JP | 2017-109812 | A | 6/2017 |

* cited by examiner

*Primary Examiner* — Alejandro Valencia

(74) *Attorney, Agent, or Firm* — Workman Nydegger

(57) ABSTRACT

A printing apparatus which appropriately deals with a medium jam occurring on the transportation belt is provided.

6 Claims, 4 Drawing Sheets

PRINTING APPARATUS

BACKGROUND

1. Technical Field

The present invention relates to printing apparatuses such as ink jet printers.

2. Related Art

There have been known printing apparatuses that perform printing on a paper sheet which is an example of a medium by ejecting ink which is an example liquid from a head. JP-A-2002-46310 discloses, as an example of such a printing apparatus, an image forming apparatus which includes a transportation belt for transporting a paper sheet by attracting the paper sheet thereto by means of electrostatic attraction.

In the image forming apparatus disclosed in JP-A-2002-46310, a paper jam may occur on the transportation belt when a paper sheet transported by the transportation belt comes into contact with the head, for example.

SUMMARY

An advantage of some aspects of the invention is that a printing apparatus that can appropriately deal with a medium jam occurring on a transportation belt is provided.

The following describes means for solving the above problem and the advantageous effect thereof. A printing apparatus according to an aspect of the invention includes a printing unit that performs printing of an image on a medium, a transportation belt that faces the printing unit and transports the medium, and a detecting section configured to detect the medium transported by the transportation belt, wherein the detecting section includes an upstream sensor disposed upstream relative to the transportation belt in a transportation direction of the medium transported by the transportation belt, a downstream sensor disposed downstream relative to the transportation belt in a transportation direction of the medium transported by the transportation belt, and an intermediate sensor disposed between the upstream sensor and the downstream sensor so as to face the transportation belt.

With this configuration, for example, even if the medium having a size smaller than the distance between the upstream sensor and the downstream sensor in the transportation direction is jammed on the transportation belt, the jammed medium can be detected by the intermediate sensor. As a result, a medium jam occurring on the transportation belt can be appropriately dealt with.

The above printing apparatus preferably further includes an anti-static unit configured to electrically neutralize the medium transported by the transportation belt when coming into contact with the medium, wherein the anti-static unit is displaceable between an anti-static position at which the anti-static unit can be in contact with the medium and a standby position at which the anti-static unit is not in contact with the medium, and the intermediate sensor is configured to detect the medium when the anti-static unit is located at the standby position.

With this configuration, electrostatic attraction force of the transportation belt for attracting the medium can be increased by the anti-static unit electrically neutralizing the medium when the transportation belt transports the medium by attracting it using electrostatic attraction.

In the above printing apparatus, it is preferred that the anti-static unit includes an anti-static belt configured to circulate in a width direction of the medium transported by the transportation belt, which is a direction perpendicular to the transportation direction of the medium, and an anti-static brush disposed on part of an outer peripheral surface of the anti-static belt, the anti-static brush is configured to be displaced between the anti-static position at which the anti-static brush faces the transportation belt and is in contact therewith and the standby position at which the anti-static brush does not face the transportation belt as the anti-static belt circulates, the anti-static belt has a first hole at a position facing the transportation belt when the anti-static belt is located at the standby position, and the intermediate sensor is disposed on the inner peripheral side of the anti-static belt and detects the medium through the first hole of the anti-static belt located at the standby position.

With this configuration, since the intermediate sensor is disposed on the inner peripheral side of the anti-static belt of the anti-static unit, a risk that the particulates generated from the medium or droplets of the printing material used for printing by the printing unit are attached on the intermediate sensor is reduced.

The above printing apparatus preferably further includes a control unit that controls the anti-static unit, wherein the anti-static belt further has a second hole at a position different from the first hole and at which the anti-static brush is not disposed, and the control unit detects the position of the anti-static unit when the position sensor disposed on the inner peripheral side of the anti-static belt detects the second hole.

With this configuration, the position of the anti-static unit can be detected with a simple configuration. In the above printing apparatus, the intermediate sensor is preferably disposed between the printing unit and the upstream sensor in the transportation direction.

With this configuration, when the medium transported by the transportation belt is jammed by coming into contact with the printing unit, the jammed medium can be accurately detected.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
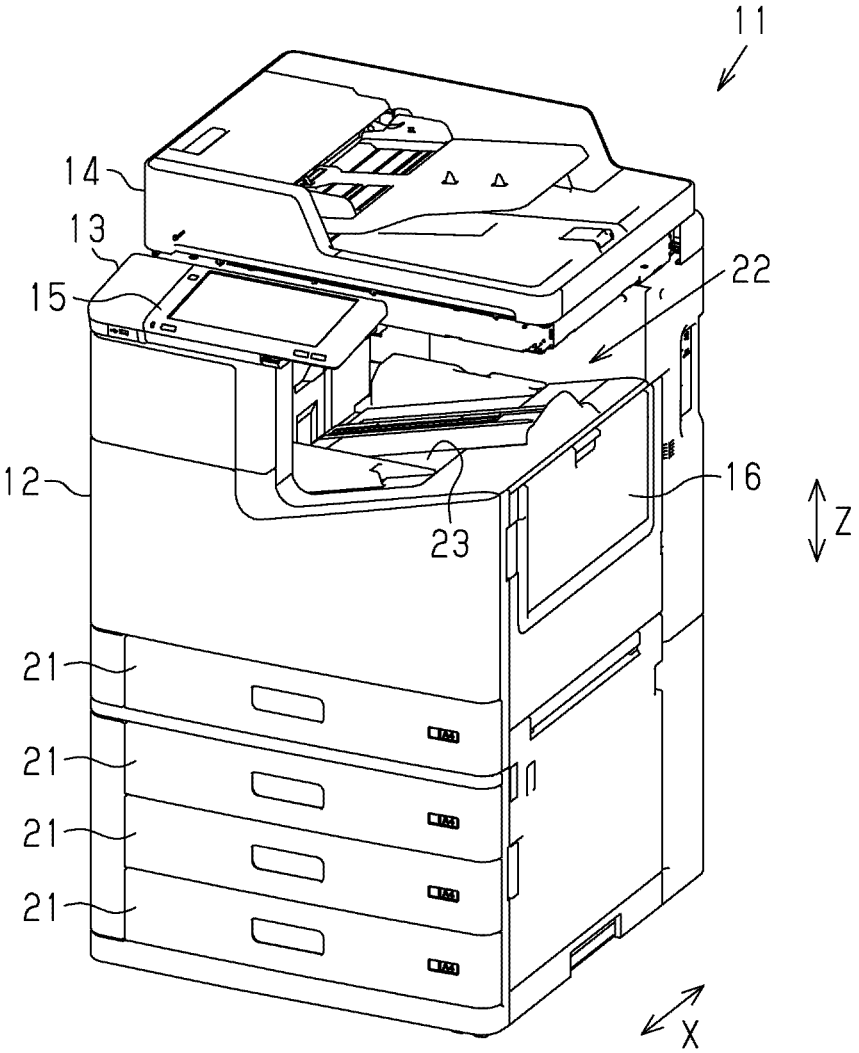
FIG. 1 is a perspective view of one embodiment of a printing apparatus.

With reference to the drawings, an embodiment of an ink jet printer which is a type of a printing apparatus will be described below. As shown in FIG. 1, a printing apparatus 11 includes a main body 12 having a cuboid shape, and an image reading unit 13 and an automatic feeder 14 disposed on the main body 12. In the printing apparatus 11, the main body 12, the image reading unit 13, and the automatic feeder 14 are stacked in an up-down direction Z from the bottom. The image reading unit 13 is configured to read an image such as texts and photos recorded on a document. The automatic feeder 14 is configured to feed a document toward the image reading unit 13. Further, the image reading unit 13 includes an operation section 15 for integrally operating the printing apparatus 11. The operation section 15 includes, for example, a touch panel LCD screen, operation buttons and the like. The main body 12 includes a plurality of medium containers 21 for housing a stack of media such as paper sheets P (see FIG. 2) in the lower part thereof. The main body 12 of the present embodiment includes a total of four medium containers 21. The medium container 21 is configured to be withdrawn from the main body 12. Further, the main body 12 includes a sheet-receiving section 22 for receiving the medium P after printing is performed on the medium P in the main body 12. The sheet-receiving section 22 has a sheet-receiving surface 23 which supports the medium P.

Figure 2:
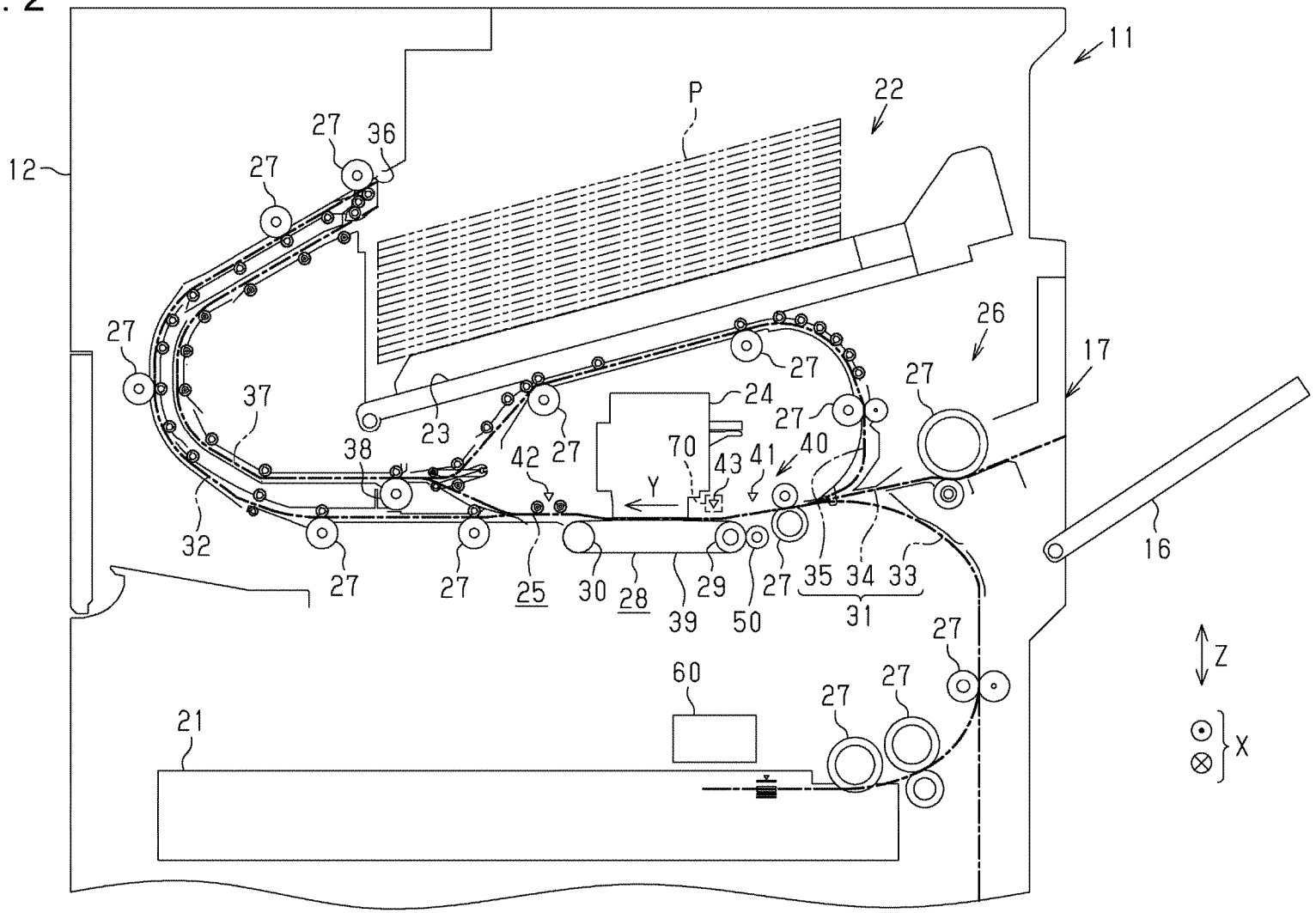
FIG. 2 is a side view of an inner structure of the printing apparatus.

As shown in FIG. 2, the printing apparatus 11 includes in the main body 12 a printing unit 24 that performs printing of an image such as texts and photos onto the medium P by using printing materials, and a transportation unit 26 that transports the medium P along a transportation path 25. The printing unit 24 according to the present embodiment prints an image by ejecting liquid such as ink, which is a type of printing material, onto a medium P. The transportation unit 26 includes a plurality of rollers 27 that are disposed along the transportation path 25, and a transportation belt 28 that is disposed to face the printing unit 24. The transportation belt 28 is configured as an endless belt wound around a driving roller 29 and a driven roller 30 which are rotatable. Further, the transportation belt 28 according to the present embodiment exhibits a black color since it contains carbon as material imparting conductivity.

The driving roller 29 is configured to rotate by a motor, which is not shown in the figure. The driven roller 30 is configured to rotate by rotation of the driving roller 29 via the transportation belt 28. As the driving roller 29 rotates, the transportation belt 28 circulates around the driving roller 29 and the driven roller 30 to thereby transport the medium P. Further, the driving roller 29 is positioned upstream relative to the printing unit 24 in the transportation direction Y of the medium P transported by the transportation belt 28. On the other hand, the driven roller 30 is positioned downstream relative to the printing unit 24 in the transportation direction Y.

The transportation path 25 includes a supply path 31 for supplying the medium P to the printing unit 24, and an output path 32 for outputting the medium P to the sheet-receiving section 22 after printing is performed by the printing unit 24. The supply path 31 includes a plurality of paths. The supply path 31 according to the present embodiment includes three paths, i.e., a first supply path 33, a second supply path 34 and a third supply path 35. The first supply path 33 is a path along which the medium P housed in the medium container 21 is transported to the printing unit 24. The second supply path 34 is a path along which the medium P inserted through a manual feeding section 17 which is exposed by opening a cover 16 provided on the right side of the main body 12 in FIG. 2 is transported to the printing unit 24. The third supply path 35 is a path along which the medium P is again transported to the printing unit 24 after printing is performed on one side of the medium P for double face printing.

The output path 32 is a path extending from the printing unit 24 to the output port 36 that is open to the upper part of the main body 12. Further, the output path 32 is curved in a substantially U-shape so that the medium P is turned over while being transported. That is, the medium P transported along the output path 32 is turned over so that one surface on which printing is performed by the printing unit 24, which is the surface upward, is turned downward. Then, the medium P outputted from the output port 36 falls on the sheet-receiving section 22 and is supported by the sheet-receiving section 22 with the printed surface facing the sheet-receiving surface 23, which is the top surface of the sheet-receiving section 22.

Further, the transportation path 25 has a branch path 37 which is branched from an intermediate position of the output path 32. The branch path 37 is a curved path extending along the output path 32, and is connected to the third supply path 35 at an intermediate position thereof. The branch path 37 is provided with a switchback roller 38 rotatable in the forward rotation direction and backward rotation direction, which is a type of the roller that constitutes the transportation unit 26. That is, the medium P is transported on the branch path 37 by the switchback roller 38 rotating forward. Then, the medium P is transported backward (switchback) toward the third supply path 35 by the switchback roller 38 rotating backward at a predetermined timing. The switchbacked medium P is transported on the third supply path 35 which extends above the printing unit 24. Here, the medium P is turned over while being transported so that the surface opposite to the printed surface faces the printing unit 24. Then, the medium P is transported back to the printing unit 24 for double face printing by the printing unit 24.

The printing apparatus 11 includes a detecting section 40 that can detect the medium P transported by the transportation unit 26. The detecting section 40 is, for example, an optical sensor and turns ON when detecting the medium P and output a predetermined signal. A plurality of detecting sections 40 are disposed in the main body 12. The detecting section 40 includes an upstream sensor 41 and a downstream sensor 42 disposed upstream and downstream to the transportation belt 28 in the transportation direction Y of the medium P, respectively. The upstream sensor 41 is configured to detect the medium P located upstream to the transportation belt 28 in the transportation path 25. Further, the downstream sensor 42 is configured to detect the medium P located downstream to the transportation belt 28 in the transportation path 25. That is, according to the present embodiment, the downstream sensor 42 turns ON after a predetermined period of time when the upstream sensor 41 turns ON while the medium P is smoothly transported by the transportation belt 28.

In the present embodiment, a risk of misdetection of the medium P is reduced by providing the upstream sensor 41 and the downstream sensor 42 upstream and downstream to the transportation belt 28 in the transportation direction Y, respectively. If the upstream sensor 41 and the downstream sensor 42 are disposed at positions facing the transportation belt 28, the upstream sensor 41 and the downstream sensor 42 detect the medium P located on the transportation belt 28. In this case, since the transportation belt 28 of the present embodiment exhibits a black color, it is difficult for the upstream sensor 41 and the downstream sensor 42 to identify the medium P from the transportation belt 28. That is, it is difficult for the downstream sensor 42 to identify the medium P on which printing materials are attached from the transportation belt 28. Further, when printing is performed on the medium P having a dark color such as black, it is difficult for the upstream sensor 41 to identify the medium P from the transportation belt 28. Therefore, detection accuracy of the medium P by the upstream sensor 41 and the downstream sensor 42 can be improved by providing the upstream sensor 41 and the downstream sensor 42 at positions that do not face the transportation belt 28.

The detecting section 40 includes an intermediate sensor 43 in addition to the upstream sensor 41 and the downstream sensor 42. The intermediate sensor 43 is disposed at a position between the upstream sensor 41 and the downstream sensor 42 in the transportation direction Y so as to face the transportation belt 28. That is, the intermediate sensor 43 is configured to detect the medium P located on the transportation belt 28 in the transportation path 25. The intermediate sensor 43 of the present embodiment is disposed between the upstream sensor 41 and the printing unit 24 in the transportation direction Y. Further, the intermediate sensor 43 is a sensor that turns ON when detecting the medium P and output a predetermined signal as with the upstream sensor 41 and the downstream sensor 42.

The printing apparatus 11 includes a charging roller 50 that makes the transportation belt 28 electrically charged. The charging roller 50 is positioned to be adjacent to the driving roller 29 with the transportation belt 28 interposed therebetween, and is in contact with a belt surface 39, which is the outer peripheral surface of the transportation belt 28. Further, the charging roller 50 is configured to rotate as the transportation belt 28 circulates. Further, the charging roller 50 rotates while being in contact with the belt surface 39 of the circulating transportation belt 28 to thereby make the belt surface 39 of the transportation belt 28 electrically charged. That is, the transportation belt 28 of the present embodiment allows the medium P to be attracted to the belt surface 39 by an effect of static electricity charged by the charging roller 50. As the transportation belt 28 circulates while the medium P is attracted onto the belt surface 39 by electrostatic attraction, the medium P is transported. The charging roller 50 of the present embodiment is configured to supply positive and negative charges to the transportation belt 28 in an alternating manner. As a result, a positively charged portion and a negatively charged portion are alternately formed on the belt surface 39 of the transportation belt 28. Further, the charging roller 50 may also be configured to supply either positive or negative charge to the transportation belt 28.

As the electrically charged transportation belt 28 comes into contact with the medium P, a positively charged portion and a negatively charged portion are alternately formed on the medium P as well. Accordingly, polarization occurs between a contact surface of the medium P which is in contact with the transportation belt 28 and a print surface opposite to the contact surface. Occurrence of polarization may pose a risk that an electrostatic attraction force of the transportation belt 28 attracting the medium P is reduced. Therefore, the printing apparatus 11 of the present embodiment includes an anti-static unit 70 for neutralizing electric charges charged on the print surface of the medium P. Further, the printing apparatus 11 includes a control unit 60 for controlling the anti-static unit 70. The control unit 60 is connected to the anti-static unit 70 and the detecting section 40 via a signal line, which is not shown in the figure. The control unit 60 is configured to receive a signal transmitted from the detecting section 40. Preferably, the control unit 60 integrally controls various components of the printing apparatus 11.

The anti-static unit 70 is disposed between the upstream sensor 41 and the printing unit 24 in the transportation direction Y. Further, the anti-static unit 70 is disposed to face the transportation belt 28. The anti-static unit 70 of the present embodiment is disposed to overlap with the intermediate sensor 43 in the transportation direction Y. The anti-static unit 70 is configured to neutralize electric charges on the print surface of the medium P when coming into contact with the print surface of the medium P on the transportation belt 28. As the anti-static unit 70 neutralizes electric charges charged on the print surface of the medium P, a decrease in electrostatic attraction force of the transportation belt 28 attracting the medium P can be prevented. In addition, as the outer peripheral surface (belt surface 39) of the transportation belt 28 is charged by the charging roller 50, a positively charged portion and a negatively charged portion are also alternately formed on the inner peripheral surface of the transportation belt 28. Therefore, the printing apparatus 11 of the present embodiment preferably includes an electrical conducting plate or the like on the inner peripheral surface of the transportation belt 28 for neutralizing electric charges charged on the inner peripheral surface of the transportation belt 28.

Figure 3:
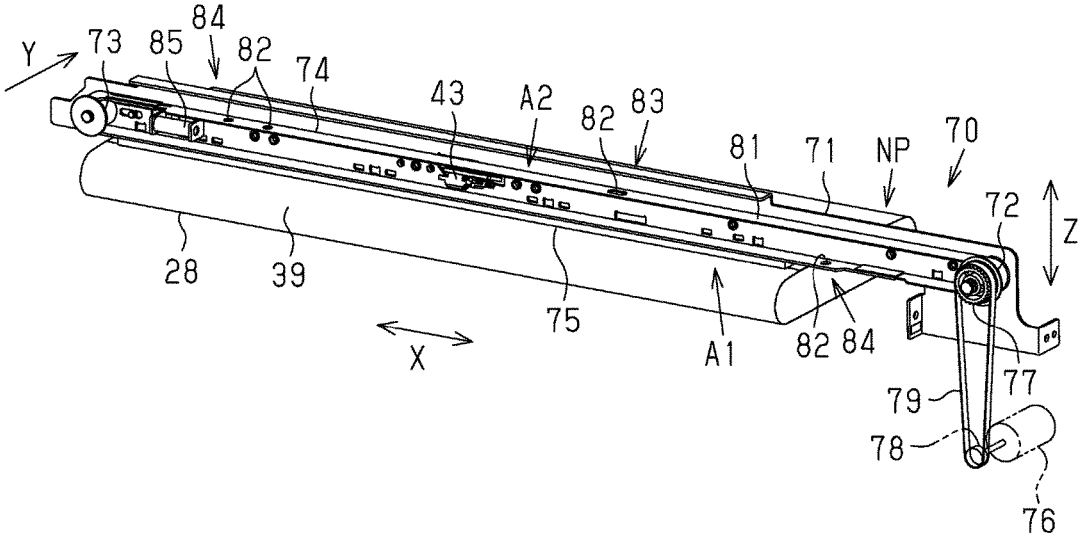
FIG. 3 is a perspective view of an anti-static unit positioned at an anti-static position.
Figure 4:
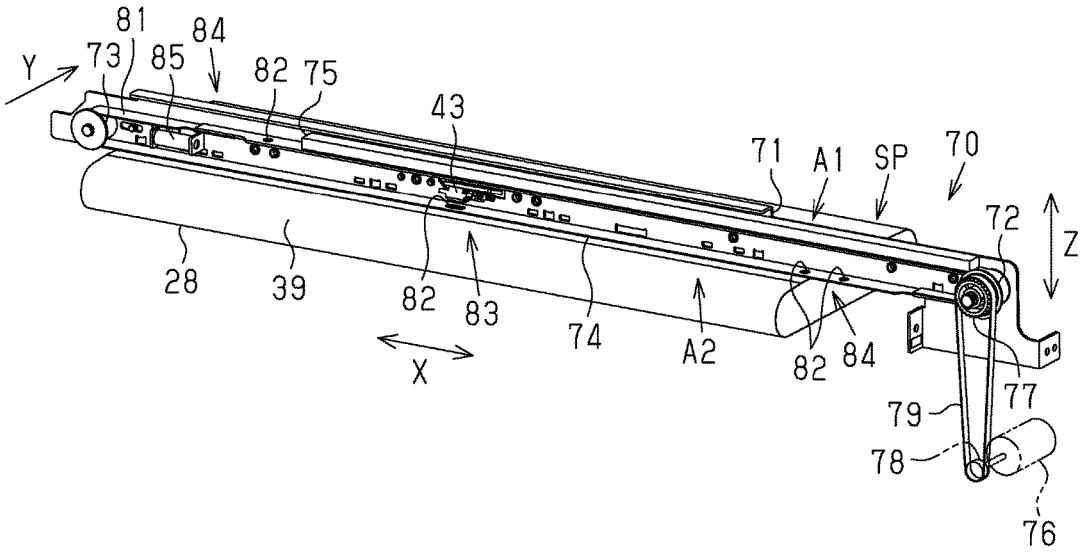
FIG. 4 is a perspective view of the anti-static unit positioned at a standby position.

As shown in FIGS. 3 and 4, the anti-static unit 70 includes a frame 71, a driving pulley 72 and a driven pulley 73 supported by the frame 71, an endless anti-static belt 74 wound around the driving pulley 72 and the driven pulley 73, and an anti-static brush 75 which extends from the anti-static belt 74. Further, the anti-static unit 70 includes a driving source 76 for driving the driving pulley 72.

The frame 71 extends in a width direction X of the medium P transported by the transportation unit 26. The width direction X is a direction different from the transportation direction Y and the up-down direction Z. In the present embodiment, it is a direction intersecting with (perpendicular to) both the transportation direction Y and the up-down direction Z. The frame 71 has a longer dimension in the width direction X than that of the transportation belt 28. The frame 71 rotatably supports the driving pulley 72 and the driven pulley 73. The driving pulley 72 and the driven pulley 73 are mounted on a surface of the frame 71 upstream in the transportation direction Y and disposed at positions separate from each other on both ends of the frame 71 in the width direction X.

A transmission gear 77 is mounted on the driving pulley 72 at a position upstream in the transportation direction Y. The transmission gear 77 is disposed coaxially with the driving pulley 72 and is configured to rotate integrally with the driving pulley 72. A transmission belt 79 is wound around the transmission gear 77 and an output gear 78. The output gear 78 is mounted on the driving source 76, which is configured by a motor, for example. That is, as the output gear 78 rotates by driving the driving source 76, the driving pulley 72 rotates together with the transmission gear 77 via the transmission belt 79. The driving source 76 may be configured to be directly mounted on the driving pulley 72. As the driving pulley 72 rotates by driving the driving source 76, the anti-static belt 74 circulates while being wound around the driving pulley 72 and the driven pulley 73.

The intermediate sensor 43, which constitutes the detecting section 40, is mounted on the frame 71 of the anti-static unit 70 as with the driving pulley 72 and the driven pulley 73. The intermediate sensor 43 is disposed between the driving pulley 72 and the driven pulley 73 in the width direction X. Specifically, the intermediate sensor 43 is disposed so as to face a center part of the transportation belt 28 in the width direction X. That is, the intermediate sensor 43 is disposed on the inner peripheral side of the anti-static belt 74, surrounded by the anti-static belt 74 which is wound around the driving pulley 72 and the driven pulley 73.

The anti-static belt 74 has a portion extending in the width direction X when wound around the driving pulley 72 and the driven pulley 73. The anti-static belt 74 is made of a flexible, electrically conductive material. The anti-static belt 74 of the present embodiment is formed by weaving an electrically conductive thread into a cloth. Further, an electrically conductive coating material is applied on the inner peripheral surface of the anti-static belt 74. The anti-static brush 75, which extends outward from the outer peripheral surface 81, is disposed on an outer peripheral surface 81 of the anti-static belt 74.

The anti-static brush 75 is disposed across a first region A1, which is a partial region of the outer peripheral surface 81 of the anti-static belt 74 in the circulation direction of the anti-static belt 74. That is, the first region A1 is a region in which the anti-static brush 75 is continuously provided in the circulation direction of the anti-static belt 74 on the outer peripheral surface 81 of the anti-static belt 74. The first region A1 of the present embodiment has a length in the width direction X slightly shorter than the width of the transportation belt 28. Further, the first region A1 has a length in the width direction X longer than the width of the medium P of the maximum size that can be printed in the printing apparatus 11. Hereinafter, a region of the outer peripheral surface 81 of the anti-static belt 74 different from the first region A1 is referred to as a second region A2. That is, the outer peripheral surface 81 of the anti-static belt 74 is made up of the first region A1 and the second region A2. In the present embodiment, the second region A2 is a region of the outer peripheral surface 81 of the anti-static belt 74 on which the anti-static brush 75 is not provided. The length of the outer peripheral surface 81 of the anti-static belt 74 occupied by the second region A2 in the circulation direction of the anti-static belt 74 is longer than the length of the first region A1.

The anti-static brush 75 is configured to neutralize electric charges on the medium P when coming into contact with the medium P. The anti-static brush 75 is made of an electrically conductive material. The driven pulley 73, which is made of a metal material, serves as a ground of the anti-static unit 70. That is, when coming into contact with the print surface of the medium P on the transportation belt 28, the anti-static unit 70 neutralizes electric charges on the print surface of the medium P to thereby remove static electricity on the print surface of the medium P.

The anti-static unit 70 is configured to be displaced between an anti-static position NP at which the anti-static unit 70 can be in contact with the medium P and a standby position SP at which the anti-static unit 70 is not in contact with the medium P. The anti-static unit 70 in FIG. 3 is located at the anti-static position NP, and the anti-static unit 70 in FIG. 4 is located at the standby position SP. The anti-static position NP is a position at which the medium P transported on the transportation belt 28 can be electrically neutralized. The standby position SP is a position at which the medium P transported on the transportation belt 28 is not electrically neutralized. That is, the anti-static position NP of the present embodiment is a position at which the first region A1 on the outer peripheral surface 81 of the anti-static belt 74 faces the transportation belt 28, and the anti-static brush 75 can be in contact with the belt surface 39 of the transportation belt 28. Further, the second region A2 partially faces the transportation belt 28 as well at the anti-static position NP of the present embodiment. On the other hand, the standby position SP of the present embodiment is a position at which the second region A2 on the outer peripheral surface 81 of the anti-static belt 74 faces the transportation belt 28, the first region A1 does not face the transportation belt 28, and the anti-static brush 75 is not in contact with the belt surface 39 of the transportation belt 28.

As the anti-static belt 74 circulates while being wound around the driving pulley 72 and the driven pulley 73, the anti-static unit 70 displaces between the anti-static position NP and the standby position SP. When the driving pulley 72 shown in FIG. 3 rotates in a counterclockwise rotation, the anti-static unit 70 of the present embodiment displaces from the anti-static position NP to the standby position SP. Further, when the driving pulley 72 shown in FIG. 4 rotates in a clockwise rotation, the anti-static unit 70 of the present embodiment displaces from the standby position SP to the anti-static position NP. That is, the anti-static unit 70 is displaced between the anti-static position NP and the standby position SP by the control unit 60 controlling the driving source 76 to rotate the output gear 78 both in the forward rotation direction and the backward rotation direction as appropriate. Alternatively, the anti-static unit 70 may be configured to be displaced between the anti-static position NP and the standby position SP by the output gear 78 rotating in either the forward rotation direction or the backward rotation direction.

Further, the anti-static belt 74 has a plurality of holes 82 on the outer peripheral surface 81. The holes 82 penetrate through the anti-static belt 74 from the outer peripheral surface 81 to the inner peripheral surface. The respective holes 82 are disposed in the second region A2 of the anti-static belt 74. The holes 82 constitute a first hole 83 and a second hole 84. The first hole 83 is the hole 82 that enables the intermediate sensor 43 to detect the medium P therethrough over the anti-static belt 74. The first hole 83 is disposed at a position which faces a center part of the transportation belt 28 in the width direction X when the anti-static unit 70 is located at the standby position SP. That is, the anti-static unit 70 is configured such that the first hole 83 is located immediately under the intermediate sensor 43 when the anti-static unit 70 is located at the standby position SP. The intermediate sensor 43 is configured to detect the medium P through the first hole 83 when the anti-static unit 70 is located at the standby position SP.

The second hole 84 is the hole 82 that enables the control unit 60 to detect the position of the anti-static unit 70. The plurality of holes 82 that constitute the second hole 84 is disposed at two positions which are outside the both ends of the first region A1 in the circulation direction of the anti-static belt 74. One hole 82 is disposed at one of these two positions, and two holes 82 are arranged side by side at the other of two positions. That is, the second hole 84 of the present embodiment is composed of a total of three holes 82. In addition, these two positions are spaced from each other with the phase difference of substantially 180 degrees in the circulation direction of the anti-static belt 74.

The anti-static unit 70 includes a position sensor 85 for detecting the second hole 84. The position sensor 85 is mounted on a surface of the frame 71 upstream in the transportation direction Y and disposed at a position close to the driven pulley 73 in the width direction X. The position sensor 85 is formed by an optical sensor, for example. The control unit 60 detects the position of the anti-static unit 70 by the position sensor 85 detecting the second hole 84. In the present embodiment, when the position sensor 85 detects one hole 82, the control unit 60 detects that the anti-static unit 70 is located at the anti-static position NP. Further, when the position sensor 85 detects two holes 82, the control unit 60 detects that the anti-static unit 70 is located at the standby position SP.

In the present embodiment, the hole 82 corresponding to the first hole 83 and the hole 82 corresponding to the second hole 84 have different shapes in order to prevent misdetection of the first hole 83 and the second hole 84 by the position sensor 85. The hole 82 corresponding to the first hole 83 is formed in an oblong shape extending in the circulation direction of the anti-static belt 74 longer than the hole 82 corresponding to the second hole 84. That is, the hole 82 which constitutes the first hole 83 is different from the hole 82 which constitutes the second hole 84.

Figure 5:
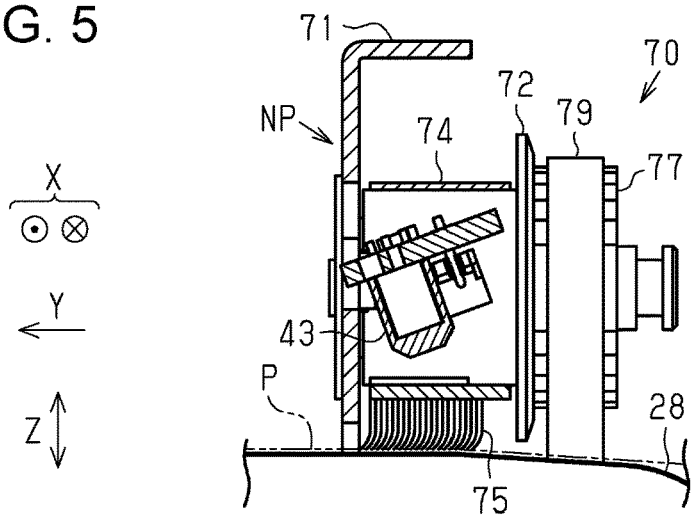
FIG. 5 is a cross-sectional view of the anti-static unit and an intermediate sensor positioned at an anti-static position.

Next, effects of the printing apparatus 11 having the above configuration will be described. As shown in FIG. 5, during transportation of the medium P by the transportation belt 28, the anti-static unit 70 is located at the anti-static position NP for electrically neutralizing the medium P. The anti-static unit 70 electrically neutralizes the medium P by the distal end of the anti-static brush 75 being in contact with the medium P transported on the transportation belt 28. Here, the intermediate sensor 43 is covered by the anti-static belt 74 since the anti-static unit 70 is located at the anti-static position NP. Accordingly, a risk that the particulates generated from the medium P due to the anti-static brush 75 being in contact with the medium P or droplets of the printing material ejected from the printing unit 24 are attached on the intermediate sensor 43 is reduced. Meanwhile, when the transportation belt 28 transports the medium P, part of the medium P may interfere with other members such as the printing unit 24, causing a medium jam on the transportation belt 28. In this case, the control unit 60 stops driving of the transportation unit 26 and displays the occurrence of medium jam on the LCD screen of the operation section 15 to prompt a user to remove the jammed medium P.

The control unit 60 determines that a medium jam has occurred on the transportation belt 28 if the downstream sensor 42 does not turn ON within a predetermined period of time after the upstream sensor 41 for detecting the medium P turns ON. Particularly, during double-face printing, a medium jam is likely to occur since the electrostatic attraction force on the transportation belt 28 diminishes or the medium P warps due to the printing material attached on one surface. When the jammed medium P is the medium P having a large size in the transportation direction Y, part of the medium P can be detected by the upstream sensor 41. Then, when the ON state of the upstream sensor 41 is released, the control unit 60 determines that the jammed medium P has been removed by a user. The medium P having a large size in the transportation direction Y refers to, for example, the medium P having a size larger than the distance between the upstream sensor 41 and the downstream sensor 42 in the transportation direction Y.

On the other hand, when the jammed medium P is the medium P having a small size in the transportation direction Y, the medium P may have already passed by the upstream sensor 41 when the control unit 60 determines that a medium jam has occurred and stops driving of the transportation unit 26. That is, there may be a case where the medium P jammed on the transportation belt 28 cannot be detected by the upstream sensor 41. In this case, there is a risk that the control unit 60 cannot detect removal of the medium P even if the jammed medium P is removed by a user. The medium P having a small size in the transportation direction Y refers to, for example, the medium P having a size smaller than the distance between the upstream sensor 41 and the downstream sensor 42 in the transportation direction Y. Therefore, the printing apparatus 11 of the present embodiment includes an intermediate sensor 43 for detecting the medium P on the transportation belt 28.

Figure 6:
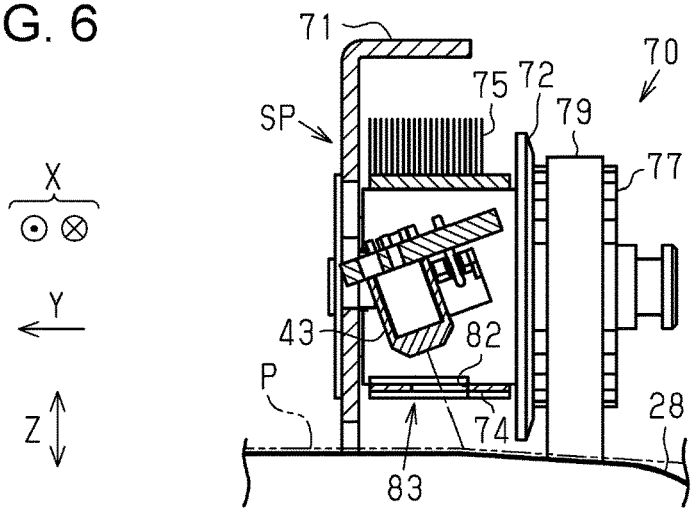
FIG. 6 is a cross-sectional view of the anti-static unit and the intermediate sensor positioned at a standby position.

As shown in FIG. 6, when the medium P having a small size in the transportation direction Y is jammed on the transportation belt 28, the printing apparatus 11 stops driving of the transportation belt 28 and displaces the anti-static unit 70 from the anti-static position NP to the standby position SP. When the anti-static unit 70 displaces to the standby position SP, the first hole 83 is located immediately under the intermediate sensor 43. Then, the intermediate sensor 43 detects the medium P jammed on the transportation belt 28 through the first hole 83. On detecting the medium P, the intermediate sensor 43 becomes ON state. When the jammed medium P is removed from the transportation belt 28, the ON state of the intermediate sensor 43 is released. When the ON state of the intermediate sensor 43 is released, the control unit 60 determines that the jammed medium P has been removed. That is, the intermediate sensor 43 is a sensor for detecting when a medium jam that has occurred on the transportation belt 28 is resolved.

According to the aforementioned embodiment, the following effects can be obtained.

(1) For example, even if the medium P having a size smaller than the distance between the upstream sensor 41 and the downstream sensor 42 in the transportation direction Y is jammed on the transportation belt 28, the jammed medium P can be detected by the intermediate sensor 43. As a result, a medium jam occurring on the transportation belt 28 can be appropriately dealt with.

(2) Since the anti-static unit 70 that can electrically neutralize the medium P is provided, electrostatic attraction force of the transportation belt 28 for attracting the medium P can be increased by the anti-static unit 70 electrically neutralizing the medium P when the transportation belt 28 transports the medium P by attracting it using electrostatic attraction.

(3) Since the intermediate sensor 43 is disposed on the inner peripheral side of the anti-static belt 74 of the anti-static unit 70, a risk that the particulates generated from the medium P or droplets of the printing material used for printing by the printing unit 24 are attached on the intermediate sensor 43 is reduced.

(4) The control unit 60 detects the position of the anti-static unit 70 when the position sensor 85 disposed on the inner peripheral side of the anti-static belt 74 detects the second hole 84. Accordingly, the position of the anti-static unit 70 can be detected with a simple configuration.

(5) The intermediate sensor 43 is disposed between the printing unit 24 and the upstream sensor 41 in the transportation direction Y. That is, the intermediate sensor 43 detects the print surface of the medium P on which a printing material is not attached. Accordingly, when the medium P transported by the transportation belt 28 is jammed by coming into contact with the printing unit 24, the jammed medium P can be accurately detected.

(6) Upon occurrence of a medium jam, the anti-static unit 70 displaces to the standby position SP so that the anti-static brush 75 becomes the state that is not in contact with the medium P on the transportation belt 28. Accordingly, in removing the jammed medium P, a risk that the printing material attached on the medium P is attached on the anti-static brush 75 can be reduced.

(7) Since the intermediate sensor 43 is disposed so as to overlap with the anti-static unit 70 in the transportation direction Y, an increase in size of the apparatus can be prevented. The above embodiment may be modified as described below. In addition, the following modified examples may be combined as appropriate.

Figure 7:
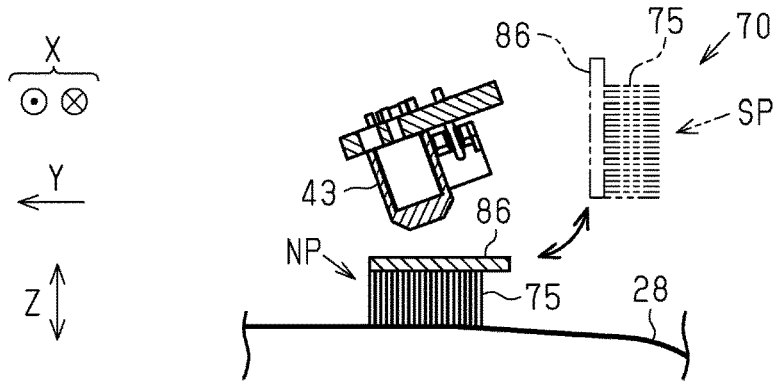
FIG. 7 is a cross-sectional view of a modified example of the anti-static unit.

As shown in FIG. 7, the anti-static unit 70 is not limited to the configuration having the anti-static belt 74. For example, the anti-static unit 70 may be configured to have a strip-shaped substrate 86 and the anti-static brush 75. In this case, the anti-static unit 70 may be configured to be displaced between the anti-static position NP and the standby position SP by the substrate 86 and the anti-static brush 75 moving relative to the intermediate sensor 43 in the transportation direction Y and the up-down direction Z.

The intermediate sensor 43 may be disposed at a position that does not overlap the printing unit 70 in the transportation direction Y. For example, the intermediate sensor 43 may be arranged parallel with the anti-static unit 70 in the transportation direction Y.

The anti-static unit 70 may be configured such that only the first region A1 faces the transportation belt 28 when located at the anti-static position NP.

The anti-static unit 70 may be configured such that part of the first region A1 as well as the second region A2 faces the transportation belt 28 when located at the standby position SP.

When determining that the medium P is jammed on the transportation belt 28, the control unit 60 may not necessarily displace the anti-static unit 70 from the anti-static position NP to the standby position SP. For example, the control unit 60 may be configured to displace the anti-static unit 70 from the anti-static position NP to the standby position SP to confirm whether the medium P is not left on the transportation belt 28 when removal of the medium P jammed on the transportation belt 28 is inputted by a user via the operation section 15.

The intermediate sensor 43 may be disposed downstream to the printing unit 24 in the transportation direction Y.

The anti-static unit 70 may be provided with a rotary encoder instead of the position sensor 85. In this case, the control unit 60 detects the position of the anti-static unit 70 by the rotary encoder. Further, other configurations may be used to detect the position of the anti-static unit 70.

The transportation belt 28 may or may not contain carbon, and may not necessarily exhibit a black color.

The medium P is not limited to the paper sheet, and may be a fabric, a plastic film or the like.

In the above embodiment, the printing apparatus 11 may also be a fluid ejecting apparatus that performs printing by spraying or ejecting a fluid other than ink (including liquid, a liquid material which is made by dispersing or mixing a particle of a functional material in liquid, a fluid material such as gel, and a solid which can be supplied and ejected as a fluid). For example, a liquid material ejecting apparatus that performs printing by ejecting a liquid material which includes dispersed or dissolved material such as electrode material or color material (pixel material) used for production of liquid crystal displays, EL (electroluminescence) displays and surface emission displays may also be used. Further, the printing apparatus 11 may be a fluid material ejecting apparatus that ejects a fluid material such as gel (for example, physical gel), or a particulate ejecting apparatus (for example, toner jet type recording apparatus) that ejects a solid, for example, powder (particulate) such as toner. The present invention can be applied to any of the above fluid ejecting apparatuses. Further, the term "fluid" as used herein refers to, for example, liquid (including inorganic solvent, organic solvent, solution, liquid resin, liquid metal (metal melt) and the like), a liquid material, a fluid material, particulate (including particles and powder) and the like.

The entire disclosure of Japanese Patent Application No.: 2017-015154, filed Jan. 31, 2017 is expressly incorporated by reference herein.

What is claimed is:

1. A printing apparatus comprising:

a printing unit that performs printing of an image on a medium;

a transportation belt that faces the printing unit and transports the medium;

a detecting section configured to detect the medium transported by the transportation belt; and an anti-static unit configured to electrically neutralize the medium by contacting the medium transported by the transportation belt, wherein the detecting section includes:

an upstream sensor disposed upstream of the printing unit in a transportation direction of the medium transported by the transportation belt, a downstream sensor disposed downstream of the printing unit in the transportation direction, and an intermediate sensor disposed between the upstream sensor and the downstream sensor so as to face the transportation belt, wherein the anti-static unit includes:

an anti-static belt configured to circulate, and an anti-static brush disposed on part of an outer peripheral surface of the anti-static belt, wherein the anti-static brush is configured to be in contact with the transportation belt as the anti-static belt circulates, and wherein the intermediate sensor is disposed on the inner peripheral side of the anti-static belt.

2. The printing apparatus according to claim 1, wherein the intermediate sensor is disposed between the printing unit and the upstream sensor in the transportation direction.

3. The printing apparatus according to 1, further comprising a curved path for reversing the printed medium, wherein the downstream sensor is disposed upstream of the curved path in the transportation direction.

4. The printing apparatus according to 1, wherein a part of the anti-static unit is provided between the transportation belt and the intermediate sensor.

5. A printing apparatus comprising:

a printing unit that performs printing of an image on a medium;

a transportation belt that faces the printing unit and transports the medium;

a detecting section configured to detect the medium transported by the transportation belt; and an anti-static unit configured to electrically neutralize the medium by contacting the medium transported by the transportation belt, wherein the detecting section includes:

an upstream sensor disposed upstream of the printing unit in a transportation direction of the medium transported by the transportation belt, a downstream sensor disposed downstream of the printing unit in the transportation direction, and an intermediate sensor disposed between the upstream sensor and the downstream sensor so as to face the transportation belt, wherein the anti-static unit includes:

an anti-static belt configured to circulate in a width direction of the medium transported by the transportation belt, which is a direction perpendicular to the transportation direction of the medium, and an anti-static brush disposed on part of an outer peripheral surface of the anti-static belt, wherein the anti-static brush is configured to be displaced between an anti-static position at which the anti-static brush faces the transportation belt and is in contact therewith and a standby position at which the anti-static brush does not face the transportation belt as the anti-static belt circulates, wherein the anti-static belt has a first hole at a position facing the transportation belt when the anti-static belt is located at the standby position, and wherein the intermediate sensor is disposed on the inner peripheral side of the anti-static belt.

6. The printing apparatus according to claim 5, further comprising a control unit that controls the anti-static unit, wherein the anti-static belt further has a second hole at a position different from the first hole and at which the anti-static brush is not disposed, and the control unit detects the position of the anti-static unit when the position sensor disposed on the inner peripheral side of the anti-static belt detects the second hole.

* * * * *